US010347200B2

(12) United States Patent
He

(10) Patent No.: US 10,347,200 B2
(45) Date of Patent: Jul. 9, 2019

(54) LIQUID CRYSTAL DISPLAY DEVICE WITH TIME SEQUENCE CONTROLLER CIRCUIT SWITCHING OFF AND ON AN INTERIOR ANALOG CIRCUIT OF THE SOURCE DRIVER

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventor: Jian He, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 149 days.

(21) Appl. No.: 14/434,623

(22) PCT Filed: Jul. 28, 2014

(86) PCT No.: PCT/CN2014/083138

§ 371 (c)(1),
(2) Date: Apr. 9, 2015

(87) PCT Pub. No.: WO2015/101032

PCT Pub. Date: Jul. 9, 2015

(65) Prior Publication Data

US 2016/0027392 A1 Jan. 28, 2016

(30) Foreign Application Priority Data

Dec. 31, 2013 (CN) ..... 2013 1 0751737

(51) Int. Cl.
*G09G 3/36* (2006.01)

(52) U.S. Cl.
CPC ..... *G09G 3/3611* (2013.01); *G09G 3/3688* (2013.01); *G09G 2300/0404* (2013.01);
(Continued)

(58) Field of Classification Search
CPC ..... G09G 3/36; G09G 3/3611; G09G 3/3614; G09G 3/3685; G09G 3/3688;
(Continued)

(56) References Cited

U.S. PATENT DOCUMENTS 6,256,025 B1 * 7/2001 Imai ..... G09G 3/3696 345/210
2001/0003064 A1 10/2001 Tsutsui et al.
(Continued)

FOREIGN PATENT DOCUMENTS

CN 1440514 A 9/2003
CN 101118728 A 2/2008
(Continued)

OTHER PUBLICATIONS

Second Chinese Office Action and English translation dated Jan. 4, 2016, for corresponding Chinese Application No. 201310751737.2.
(Continued)

*Primary Examiner* — Alexander Eisen
*Assistant Examiner* — Nelson Lam
(74) *Attorney, Agent, or Firm* — Kinney & Lange, P.A.

(57) ABSTRACT

The present invention discloses a liquid crystal display device, comprising a time sequence controller configured to receive external control signals, generate driving control signals based on the external control signals, and send respective driving control signals to the source driver and the gate driver. The time sequence controller comprises a logic signal generating module configured to generate a logic signal, which is used to switch off an interior analog circuit of the source driver when the liquid crystal display
(Continued)

panel is in a drive-stopping state and to switch on the analog circuit when the liquid crystal display panel is in a driving state, a source driver and a gate driver configured to respectively generate driving signals based on the driving control signals and the logic signal and send the driving signals to the liquid crystal display panel, and a liquid crystal display panel configured to display images in accordance with the received driving signals. The present invention also discloses a method for driving a liquid crystal display. The present invention is made so that the time sequence controller outputs the logic signal to the source driver so as to switch off the interior analog circuit of the source driver within the drive-stopping time duration, thereby reducing the power consumption of the liquid crystal display device.

9 Claims, 4 Drawing Sheets

(52) U.S. Cl.
CPC ..... *G09G 2300/0417* (2013.01); *G09G 2310/0289* (2013.01); *G09G 2330/022* (2013.01)

(58) Field of Classification Search
CPC ..... G09G 3/3692; G09G 3/3696; G09G 2310/0289; G09G 2310/0291
USPC ..... 345/87–104, 213
See application file for complete search history.

(56) References Cited

U.S. PATENT DOCUMENTS

2007/0120804 A1* 5/2007 Su ..... G09G 3/3614 345/99
2008/0143665 A1 6/2008 Nishimura
2008/0158204 A1* 7/2008 Chang ..... G09G 3/3677 345/204
2008/0186297 A1* 8/2008 Morita ..... G09G 3/3688 345/211
2009/0102775 A1* 4/2009 Ku ..... G09G 3/3648 345/92
2012/0133635 A1* 5/2012 Ji ..... G09G 3/3688 345/212
2014/0225881 A1* 8/2014 Takahashi ..... G09G 3/3614 345/209
2015/0084941 A1* 3/2015 He ..... G09G 3/3614 345/209
2018/0190229 A1* 7/2018 Wang ..... G09G 3/3677

FOREIGN PATENT DOCUMENTS

CN 101425265 A 5/2009
CN 101996589 A 3/2011
CN 103021351 A 4/2013
CN 103310756 A 9/2013
CN 103810979 A 5/2014
JP H0519719 A 1/1993
WO 2013024754 A1 2/2013

OTHER PUBLICATIONS

International Search Report and Written Opinion dated Oct. 11, 2014 for corresponding PCT Application No. PCT/CN2014/083138.
English translation of first Chinese Office Action dated May 26, 2015, for corresponding Chinese Application No. 201310751737.2.
English translation of Box V of Written Opinion dated Oct. 27, 2014 for corresponding PCT Application No. PCT/CN 2014/083138.
European Office Action, for European Patent Application No. 14877263.5, dated May 3, 2018, 6 pages.

* cited by examiner

LIQUID CRYSTAL DISPLAY DEVICE WITH TIME SEQUENCE CONTROLLER CIRCUIT SWITCHING OFF AND ON AN INTERIOR ANALOG CIRCUIT OF THE SOURCE DRIVER

BACKGROUND OF THE INVENTION

Field of the Invention

The present invention relates to the technical field of liquid crystal display, and in particular, to a liquid crystal display device and a display driving method therefor which can reduce power consumption.

Description of the Related Art

FIG. 1 is a schematic structural diagram of a liquid crystal display device in the prior art. As shown in FIG. 1, the liquid crystal display device in the prior art mainly comprises a liquid crystal display (LCD) panel, a source driver, a gate driver, and a time sequence controller (Tcon). Signals transmitted to the liquid crystal display device from the outside comprise display image signals R, G, B, an enabling signal (DE), a clock signal (MCLK), a vertical synchronizing signal (Vsync) and a horizontal synchronizing signal (Hsync). The time sequence controller sends an image signal (DATA), a row starting signal (STH), a latching signal (TP) and a polarity reversing signal (POL) to the source driver, and sends a column starting signal (STV), a column clock signal (CPV) and an output enabling signal (OE) to the gate driver, so that the LCD panel displays images by driving of the source driver and the gate driver.

When a metal oxide thin film transistor is used in the liquid crystal display panel, since an indium gallium zinc oxide thin film transistor (IGZO TFT) has a leakage current less than 1 pA, compared to an amorphous silicon thin film transistor (a-Si TFT) and a low temperature poly-silicon thin film transistor (LTPS TFT), and a driving frequency of the liquid crystal display panel is reduced to 1-5 Hz from 30-60 Hz. In this way, although the number of times for driving the TFTs is reduced, orientations of liquid crystal molecules still can be maintained without damaging a picture, thereby significantly reducing power consumption of the liquid crystal display panel. For example, an amount of electricity consumption of the liquid crystal display panel may be reduced to ⅕-1/10 of a former amount of electricity consumption (without considering an amount of electricity consumption of a backlight assembly).

In the prior art, when the liquid crystal display panel is driven at 60 Hz by using a-si (amorphous silicon) TFTs and LTPS (Low Temperature Poly-Silicon) TFTs, the liquid crystal display panel updates the displayed pictures every 1/60 second (one frame). When performing a 1 Hz drive-stopping mode by IGZO TFTs, the liquid crystal display panel, within one second during which the liquid crystal display panel displays a static picture, updates the displayed picture only at the first 1/60 second and is in an off state within the remaining 59/60 second. In other words, within the remaining 59/60 second, processors will not send updated picture data to Tcon, and the Tcon will not send updated picture data to the source driver.

For the above frequency reduction drive-stopping mode of the IGZO TFTs, when liquid crystal display panel displays a static picture, the processor will not send updated picture data to the time sequence controller and the time sequence controller will not send updated picture data to the source driver within 59/60 of a second, during which an interior analog circuit of the source driver, however, is being in a working state and consequently generates a considerable loss in power consumption. Thus, there is a need to develop a liquid crystal display device and a display driving method therefor which can reduce power consumption, so as to eliminate unnecessary loss in power consumption.

SUMMARY OF THE INVENTION

In order to solve the above problems in the prior art, the present invention provides a liquid crystal display device and a display driving method therefor.

According to one aspect of the present invention, there is provided a liquid crystal display device, comprising a liquid crystal display panel, a source driver, a gate driver and a time sequence controller, wherein:

the time sequence controller is configured to receive external control signals, generate driving control signals based on the external control signals, and send respective driving control signals to the source driver and the gate driver;

the time sequence controller further comprises a logic signal generating module configured to generate a logic signal which is used to switch off an interior analog circuit of the source driver when the liquid crystal display panel is in an drive-stopping state and to switch on the interior analog circuit of the source driver when the liquid crystal display panel is in a driving state;

the source driver and the gate driver are configured to respectively generate driving signals based on the driving control signals and the logic signal and send the driving signals to the liquid crystal display panel;

the liquid crystal display panel is configured to display images in accordance with the received driving signals.

According to another aspect of the present invention, there is also provided a display driving method, comprising:

step S1 of receiving external control signals by a time sequence controller, generating driving control signals and a logic signal based on the external control signals, and sending the respective driving control signals and logic signal to a source driver and a gate driver, the logic signal being used to switch off an interior analog circuit of the source driver when a liquid crystal display panel is in a drive-stopping state and to switch on the interior analog circuit of the source driver when the liquid crystal display panel is in a driving state;

step S2 of generating driving signals respectively according to the driving control signals and the logic signal and sending the driving signals to the liquid crystal display panel, by the source driver and the gate driver; and step S3 of displaying images by the liquid crystal display panel according to the received driving signals.

For the case where the frequency reduction drive-stopping mode is applied to the IGZO TFTs, the present invention is made to output ON/OFF signals by the time sequence controller to the source driver, so that the interior analog circuit of the source driver is switched off within a drive-stopping time duration, thereby further reducing the power consumption of the liquid crystal display device, for example, reducing an amount of electricity consumption of the liquid crystal display panel to 1/20 of that of an existing liquid crystal display panel (without considering an amount of electricity consumption of a backlight assembly), and that the interior analog circuit of the source driver is switched on when the picture needs to be updated, thereby enabling normal update of the pictures displayed by the liquid crystal display panel.

DETAILED DESCRIPTION OF EMBODIMENTS OF THE INVENTION

The present invention will be further described hereinafter in detail in conjunction with preferred embodiments and with reference to the attached drawings, so that purposes, technical solutions and advantages of the present invention become more clear and apparent.

Figure 1:
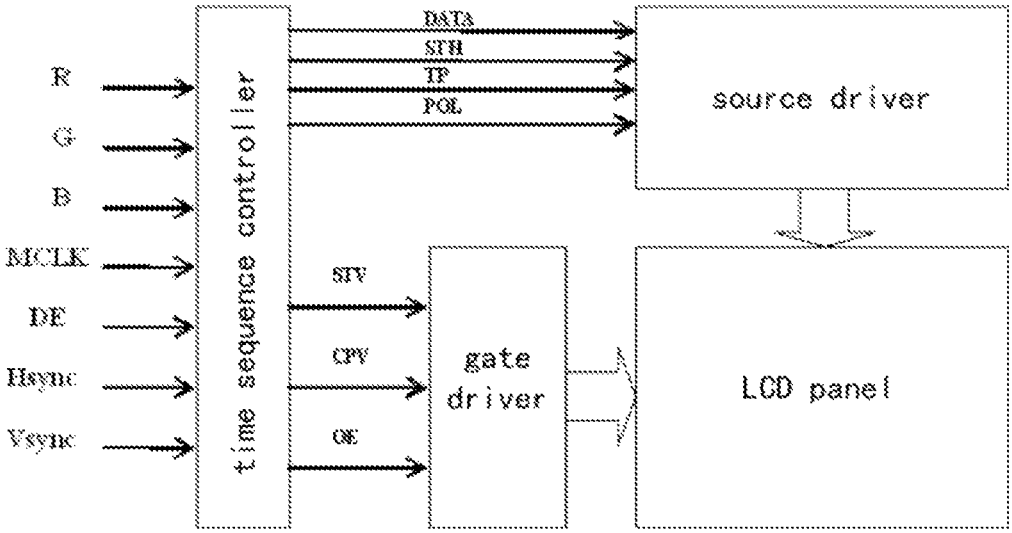
Fig. 1 Prior Art
FIG. 1 is a schematic structural diagram of a liquid crystal display device in the prior art.
Figure 2:
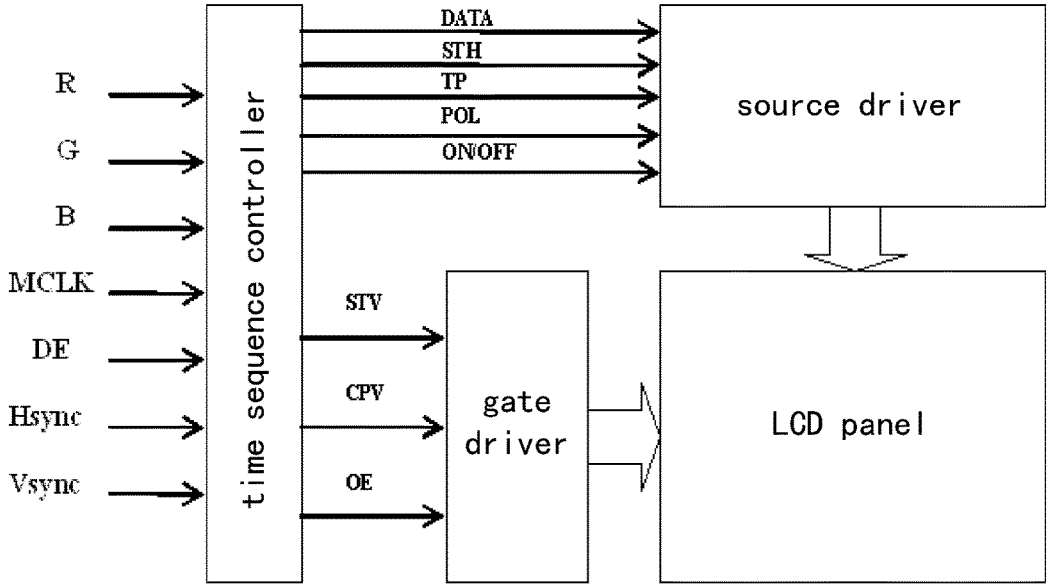
FIG. 2 is a schematic structural diagram of a liquid crystal display device according to the present invention.
Figure 3:
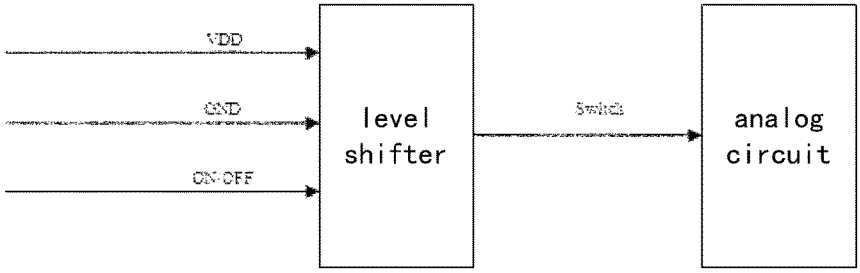
FIG. 3 is a signal flow diagram of a source driver according to the present invention.

FIG. 2 is a schematic structural diagram of a liquid crystal display device according to the present invention, and FIG. 3 is a signal flow diagram of a source driver according to the present invention. According to one aspect of the present invention, as shown in FIG. 2 and FIG. 3, there is provided a liquid crystal display device, comprising a liquid crystal display (LCD) panel, a source driver, a gate driver and a time sequence controller (Tcon), wherein:

the time sequence controller (Tcon) is configured to receive external control signals, generate driving control signals based on the external control signals, and send respective driving control signals to the source driver and the gate driver;

the external control signals at least comprise display image signals R, G, B for displaying an image, an enabling signal (DE) for enabling control of the display image signals, a clock signal (MCLK), a vertical synchronizing signal (Vsync) for indicating start of a frame and a horizontal synchronizing signal (Hsync) for indicating start of a row;

the time sequence controller (Tcon) further comprises a logic signal generating module configured to calculate a drive-stopping time point according to a predetermined drive-stopping frequency, and to generate a logic signal ON/OFF to be sent to the source driver when the drive-stopping time point is reached. Preferably, the logic signal generating module, when the liquid crystal display device displays a static picture, uses the frequency reduction drive-stopping strategy, that is, to calculate a drive-stopping time point according to a predetermined drive-stopping frequency, and to generate the logic signal ON/OFF to be sent to the source driver when the drive-stopping time point is reached. The logic signal ON/OFF is used to switch off an interior analog circuit of the source driver when the liquid crystal display panel is in a drive-stopping state and to switch on the interior analog circuit of the source driver when the liquid crystal display panel is in a driving state, so that the pictures displayed by the liquid crystal display panel can be normally updated, thereby reducing the power consumption of the liquid crystal display device. Specifically, the interior analog circuit of the source driver is switched off if the logic signal is OFF, and the interior analog circuit of the source driver is switched on if the logic signal is ON. Under control of the logic signal according to the present invention, an amount of electricity consumption of the liquid crystal display device can be reduced to 1/20 of the existing one (without considering an amount of electricity consumption of the backlight assembly);

the driving control signals at least comprise: image signals (DATA) for displaying an image picture, a row starting signal (STH) for indicating a start position of a row, a latch signal (TP) for latching a certain row of data which has been transmitted, and polarity reversing signals (POL) for controlling voltage polarities of respective rows of display units, which are sent to the source driver; and a column starting signal (STV) for indicating a start position of a frame, a column clock signal (CPV) and output enabling signals (OE) for enabling control of respective rows of gates, which are sent to the gate driver;

the source driver and the gate driver are configured to respectively generate driving signals based on the driving control signal and the logic signal, and send the driving signals to the liquid crystal display (LCD) panel;

the liquid crystal display (LCD) panel is configured to display images in accordance with the received driving signals.

It should be noted that the logic signal ON/OFF is only used to control on-and-off of the analog circuit in the source driver, and not to control on-and-off of digital circuits in the source driver, because the source driver needs to be switched between the drive-stopping time duration and a picture updating time duration through the digital circuits.

In FIG. 3, VDD represents a source signal outputted by DC-DC to the analog circuit of the source driver, GND represents a ground signal for the analog circuit of the source driver, and the logic signal ON/OFF outputted by the time sequence controller (Tcon), the VDD and the GND are provided to an interior level shifter of the source driver which correspondingly generates a switch signal (Switch) to be sent to the interior analog circuit of the source driver for switching operations. The analog circuit may be, for example, respective channel operational amplifiers (OP Amp) of the source driver.

Table 1 shows changes of states of the logic signal ON/OFF, the level shifter and the switch signal (Switch) according to two embodiments of the present invention, as illustrated in table 1:

TABLE 1

| EMBODIMENTS | ON/OFF | Switch | Op Amp |
|---|---|---|---|
| 1 | H | VDD | enable |
| | L | GND | disable |
| 2 | H | VDD | disable |
| | L | GND | enable |

Figure 4:
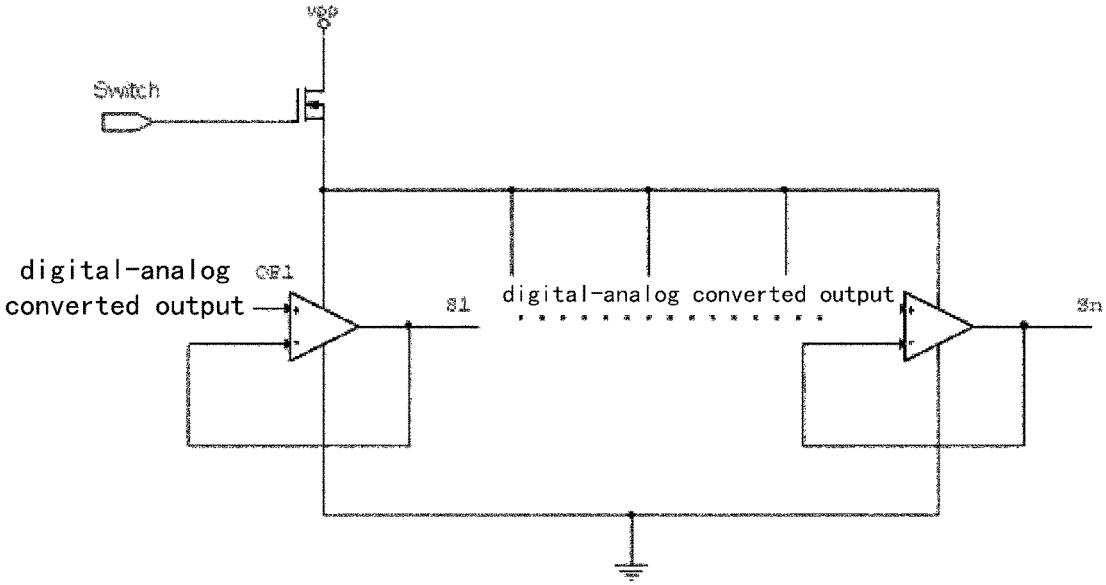
FIG. 4 is a schematic structural diagram of an analog circuit according to an embodiment of the present invention.
Figure 5:
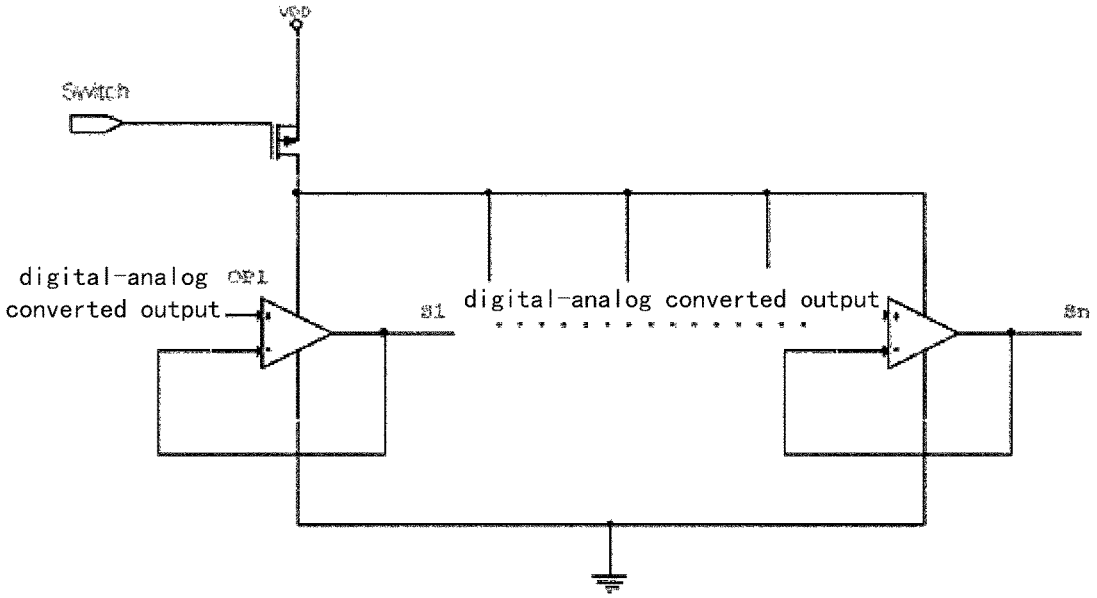
FIG. 5 is a schematic structural diagram of an analog circuit according to another embodiment of the present invention.

FIG. 4 is a schematic structural diagram of the analog circuit corresponding to the embodiment 1. As shown in FIG. 4, a N-MOS transistor is provided at a power supply terminal of the operational amplifier of the analog circuit, for example, the N-MOS transistor may be provided between the power supply terminal and the VDD source. In this embodiment, the N-MOS transistor comprises a source connected to the VDD source, a gate connected to the switch signal (Switch) outputted from the level shifter, and a drain connected to the power supply terminals of various stages of operational amplifiers. An in-phase input of the first stage operational amplifier is coupled to a digital-analog converted output of the image signal, and an output of the first stage operational amplifier is connected to an inversed-phase input of the same stage operational amplifier and to an in-phase input of a next stage operational amplifier, and so on. Finally, an output of the last stage operational amplifier is an output of the analog circuit. As can be seen from FIG. 4, in the embodiment 1, when the logic signal ON/OFF is a logic high level (H), the switch signal Switch is equal to VDD, and the N-MOS transistor in the analog circuit is turned on, thereby the VDD source supplying voltages to respective channel operational amplifiers (OP Amp). Thus, the respective channel operational amplifiers are turned on (enable), so that the picture displayed by the liquid crystal display (LCD) panel can be updated. When the logic signal ON/OFF is a logic low level (L), the switch signal Switch is equal to GND and the N-MOS transistor is turned off, such that the VDD source cannot supply voltages to the respective channel operational amplifiers (OP Amp), which are thus turned off (disable), and the picture of the liquid crystal display (LCD) panel is in an off state, thereby reducing the power consumption. FIG. 5 is a schematic structural diagram of the analog circuit corresponding to the embodiment 2. As shown in FIG. 5, a P-MOS transistor is provided at a power supply terminal of the operational amplifier of the analog circuit, for example, the P-MOS transistor may be provided between the power supply terminal and the VDD source. In this embodiment, the P-MOS transistor comprises a source connected to the VDD source, a gate coupled to the switch signal (Switch) outputted from the level shifter, and a drain connected to enabling terminals of various stage operational amplifiers. An in-phase input of the first stage operational amplifier is coupled to a digital-analog converted output of the image signal, and an output of the first stage operational amplifier is connected to an inversed-phase input of the same stage operational amplifier and to an in-phase input of a next stage operational amplifier, and so on. Finally, an output of the last stage operational amplifier is an output of the analog circuit. As can be seen from FIG. 5, in the embodiment 2, when the logic signal ON/OFF is a logic high level (H), the switch signal Switch is equal to VDD, and the P-MOS transistor is turned off, thereby the VDD source not supplying voltages to respective channel operational amplifiers (OP Amp). Thus, the respective channel operational amplifiers are turned off (disable), so that the picture of the liquid crystal display (LCD) panel is in an off state, thereby reducing the power consumption. When the logic signal ON/OFF is a logic low level (L), the switch signal Switch is equal to GND and the P-MOS transistor is turned on, such that the VDD source can supply voltages to the respective channel operational amplifiers (OP Amp). Thus, the respective channel operational amplifiers are turned on (enable), so that the picture displayed by the liquid crystal display (LCD) panel can be updated for display.

A drive-stopping mode of the liquid crystal display device can be achieved by the present invention. For example, for the drive-stopping mode of the IGZO TFTs at 1 Hz, when static pictures are displayed, the displayed pictures are updated only within the first 1/60 second, and within the remaining 59/60 second, the displayed pictures are in an off state, that is, processors do not send updated picture data to the time sequence controller (Tcon), and the time sequence controller (Tcon) does not send updated picture data to the source driver.

Table 2 shows working states of a S-IC OP Amp and a T-CON during a drive-stopping time duration and a picture updating time duration when performing the drive-stopping mode of the IGZO TFTs at 1 Hz according to the embodiment 1. When displaying the first frame "picture A", the ON/OFF outputted by the T-CON is H, and the S-IC OP Amp is an enabling state, and thus the displayed picture is updated. The second to 60th frames are maintained as the "picture A" and are within the drive-stopping time duration, and the S-IC OP Amp is in a disabling state. The 61st fame is also the picture A, and the ON/OFF outputted by the T-CON is H, and the S-IC OP Amp is an enabling state, and thus the displayed picture is updated. The 62 nd to 120th fames are maintained as the "picture A" and are within the drive-stopping time duration, and the S-IC OP Amp is in the disabling state. The 121st fame is also the picture A, the ON/OFF outputted by the T-CON is H, and the S-IC OP Amp is in the enabling state, and thus the displayed picture is updated. The 122nd to 125th fames are maintained as the "picture A" and are within the drive-stopping time duration, and the S-IC OP Amp is in the disabling state. The 126th frame is switched to display a picture B due to updating of the picture, because the ON/OFF outputted by the T-CON is H, the S-IC OP Amp is in the enabling state, and the displayed picture is updated.

TABLE 2

| | Displayed picture | | | | | | | | |
|---|---|---|---|---|---|---|---|---|---|
| | picture A | . . . | picture A | picture A | . . . | picture A | picture A | . . . | picture B |
| Time (s) | 1/60 | . . . | 60/60 | 61/60 | . . . | 120/60 | 121/60 | . . . | 126/60 |
| Number of frame picture | 1st frame updated | . . . unchanged | 60th frames unchanged | 61st frames updated | . . . unchanged | 120th frames unchanged | 121th frames updated | . . . unchanged | 126th frames updated |
| ON/Off outputted by T-CON | H | L | L | H | L | L | H | L | H |
| S-IC OP Amp | enable | disable | disable | enable | disable | disable | enable | disable | Enable |

For a drive-stopping mode of the IGZO TFTs at 2 Hz, when displaying static pictures, the displayed pictures are updated only at the 1st/60 second and 31st/60 second, and within the rests of the second (58/60 seconds), the displayed pictures are in an off state, that is, processors do not send updated picture data to the time sequence controller, and the time sequence controller does not send updated picture data to the source driver.

Table 3 shows working states of a S-IC OP Amp and a T-CON during a drive-stopping time duration and a picture updating time duration when performing the drive-stopping mode of the IGZO TFTs at 1 Hz according to the embodiment 2. When displaying the first frame "picture A", the ON/OFF outputted by the T-CON is H, and the S-IC OP Amp is an enabling state, and thus the displayed picture is updated. The second to 30th frames are maintained as the "picture A" and are within the drive-stopping time duration, and the S-IC OP Amp is in a disabling state. The 31st fame is also the picture A, the ON/OFF outputted by the T-CON is H, and the S-IC OP Amp is an enabling state, and thus the displayed picture is updated. The 32nd to 60th fames are maintained as the "picture A" and are within the drive-stopping time duration, and the S-IC OP Amp is in the disabling state. The 61st fame is also the picture A, the ON/OFF outputted by the T-CON is H, and the S-IC OP Amp is the enabling state, and thus the displayed picture is updated. The 62nd to 65th fames are maintained as the "picture A" and are within the drive-stopping time duration, and the S-IC OP Amp is in the disabling state. The 66th frame is switched to display a picture B due to update of the picture, because the ON/OFF outputted by the T-CON is H, the S-IC OP Amp is in the enabling state, and the displayed picture is updated.

TABLE 3

| | Displayed picture | | | | | | | | |
|---|---|---|---|---|---|---|---|---|---|
| | picture A | . . . | picture A | picture A | . . . | picture A | picture A | . . . | picture B |
| Time (s) | 1/60 | . . . | 30/60 | 31/60 | . . . | 60/60 | 61/60 | . . . | 66/60 |
| Number of frame picture | 1st frame updated | . . . unchanged | 30th frame unchanged | 31st frame updated | . . . unchanged | 60th frame unchanged | 61st frame updated | . . . unchanged | 66th frame updated |
| ON/Off outputted by T-CON | H | L | L | H | L | L | H | L | H |
| S-IC OP Amp | enable | disable | disable | enable | disable | disable | enable | disable | enable |

Figure 6:
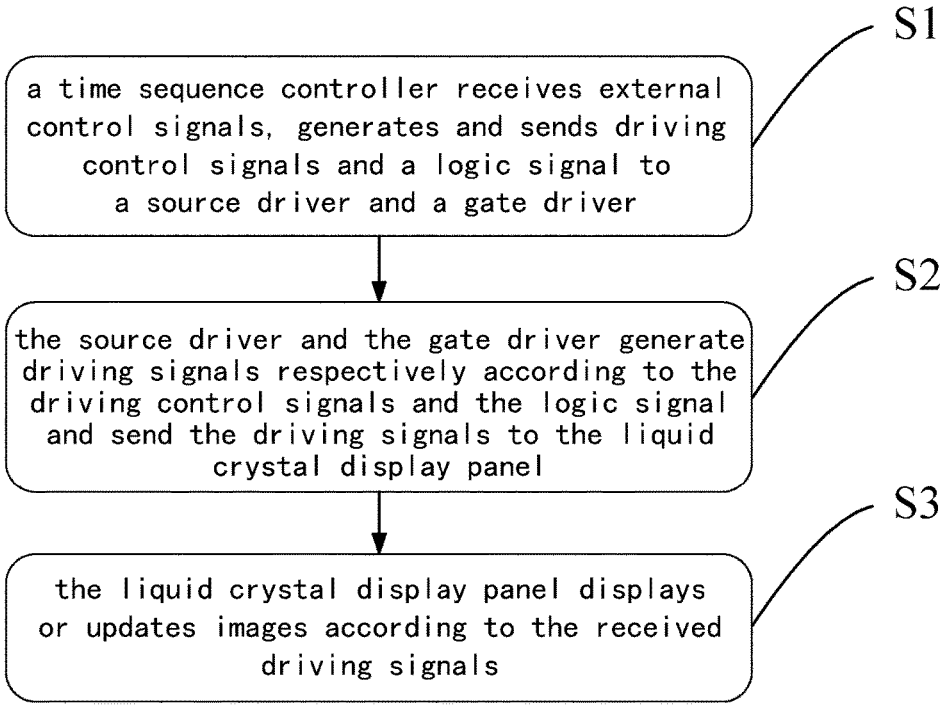
FIG. 6 is a flowchart of a display driving method according to the present invention.

FIG. 6 is a flowchart of a display driving method according to the present invention. According to another aspect of the present invention, as shown in FIG. 6, there is also provided a display driving method, comprising:

step S1 using a time sequence controller to receive external control signals, generating driving control signals and a logic signal based on the external control signals, and sending the respective driving control signals and logic signal to a source driver and a gate driver;

the external control signals at least comprise display image signals R, G, B, an enabling signal (DE), a clock signal (MCLK), a vertical synchronizing signal (Vsync) and a horizontal synchronizing signal (Hsync);

the time sequence controller (Tcon) is configured to calculate a drive-stopping time point according to a predetermined drive-stopping frequency, and to generate the logic signal ON/OFF to be sent to the source driver when the drive-stopping time point is reached. Preferably, when the liquid crystal display device displays a static picture, the above frequency reduction drive-stopping strategy is used, that is, a drive-stopping time point is calculated according to a predetermined drive-stopping frequency, and the logic signal ON/OFF to be sent to the source driver is generated when the drive-stopping time point is reached, the logic signal ON/OFF is used to switch off an interior analog circuit of the source driver when the liquid crystal display panel is in a drive-stopping state and to switch on the interior analog circuit of the source driver when the liquid crystal display panel is in a driving state, so that the picture displayed by the liquid crystal display panel can be normally updated, thereby reducing the power consumption of the liquid crystal display device. Specifically, the interior analog circuit of the source driver is switched off if the logic signal is OFF; the interior analog circuit of the source driver is switched on if the logic signal is ON;

the driving control signals at least comprise image signals (DATA), a row starting signal (STH), a latch signal (TP), and polarity reversing signals (POL) to be sent to the source driver, and a column starting signal (STV), a column clock signal (CPV) and output enabling signals (OE), which are sent to the gate driver;

step S2 of by the source driver and the gate driver, generating driving signals respectively according to the driving control signals and the logic signal and sending the driving signals to the liquid crystal display (LCD) panel; and step S3 of displaying an image by the liquid crystal display (LCD) panel according to the received driving signals.

The above method of the present invention can effectively reduce power consumption of the liquid crystal display device. In one embodiment of the present invention, an amount of electricity consumption of the liquid crystal display panel can be reduced to 1/20 of the existing one, without considering an amount of electricity consumption of a backlight assembly.

As can be seen from the above, for the frequency reduction drive-stopping mode used for the IGZO TFTs, the present invention is made to output ON/OFF signals by the time sequence controller to the source driver, so that the interior analog circuit of the source driver is switched off within a drive-stopping time duration, and is switched on when the picture needs to be updated, and thus the picture displayed by the panel can be normally updated, thereby achieving the purpose of reducing the power consumption of the liquid crystal display device.

Purposes, technical solutions and advantageous effects of the present invention have been further illustrated in the above specific embodiments. It should be understood that the above description is merely used to illustrate specific embodiments of the present invention, but not to limit the present invention. All of changes, equivalent alternatives, improvements, made within principles and spirit of the disclosure, should be included within the scope of the present invention.

What is claimed is:

1. A liquid crystal display device, comprising a liquid crystal display panel, a source driver, a gate driver and a time sequence controller, wherein:

the time sequence controller is configured to receive external control signals, to generate driving control signals based on the external control signals, and to send respective driving control signals to the source driver and the gate driver;

the time sequence controller further comprises a logic signal generating module configured to generate a logic signal, the logic signal being used to switch off an interior analog circuit of the source driver when the liquid crystal display panel is in a drive-stopping state and to switch on the interior analog circuit of the source driver when the liquid crystal display panel is in a driving state;

the source driver and the gate driver are configured to respectively generate driving signals based on the driving control signals and the logic signal and send the driving signals to the liquid crystal display panel; and the liquid crystal display panel is configured to display images in accordance with the driving signals received;

wherein the logic signal generating module is configured to calculate a drive-stopping time duration according to a predetermined drive-stopping frequency, and to generate the logic signal to be sent to the source driver when the drive-stopping time duration is reached;

wherein the drive-stopping time duration is calculated such that when displaying static pictures, times for updating the static pictures within one second is equal to the predetermined drive-stopping frequency, a time duration for each updating is 1/60 second, and the drive-stopping time duration is equal to:

(1−the predetermined drive-stopping frequency/60) second;

wherein the source driver comprises an interior level shifter, the interior analog circuit, and a MOS transistor, the interior level shifter receives the logic signal and generates a switch signal, the interior analog circuit comprises a plurality of operational amplifiers, a gate of the MOS transistor is coupled with the switch signal, a source of the MOS transistor is coupled with a VDD source, and a drain of the MOS transistor is coupled with a power supply terminal of each operational amplifier.

2. The device according to claim 1, wherein the external control signals comprise display image signals for displaying the images, an enabling signal for enabling control of the display image signals, a clock signal, a vertical synchronizing signal for indicating start of a frame and a horizontal synchronizing signal for indicating start of a row.

3. The device according to claim 1, wherein the driving control signals comprise:

image signals for displaying an image picture, a row starting signal for indicating a start position of a row, a latch signal for latching a certain row of data which has been transmitted, and polarity reversing signals for controlling voltage polarities of respective rows of display units, which are sent to the source driver; and a column starting signal for indicating a start position of a frame, a column clock signal and output enabling signals for enabling control of respective rows of gates, which are sent to the gate driver.

4. The device according to claim 1, wherein the drain of the MOS transistor is directly coupled with the power supply terminal of each operational amplifier.

5. A method for driving a liquid crystal display, comprising:

receiving external control signals by a time sequence controller, generating driving control signals and a logic signal based on the external control signals, and sending the respective driving control signals and logic signal to a source driver and a gate driver, the logic signal being used to switch off an interior analog circuit of the source driver when a liquid crystal display panel is in a drive-stopping state and to switch on the interior analog circuit of the source driver when the liquid crystal display panel is in a driving state;

generating driving signals respectively according to the driving control signals and the logic signal and sending the generated driving signals to the liquid crystal display panel, by the source driver and the gate driver; and displaying images by the liquid crystal display panel according to the received driving signals;

wherein the time sequence controller calculates a drive-stopping time duration according to a predetermined drive-stopping frequency, and generates the logic signal to be sent to the source driver when the drive-stopping time duration is reached;

wherein the drive-stopping time duration is calculated such that when displaying static pictures, times for updating the static pictures within one second is equal to the predetermined drive-stopping frequency, a time duration for each updating is 1/60 second, and the drive-stopping time duration is equal to:

(1−the predetermined drive-stopping frequency/60) second;

wherein the source driver comprises an interior level shifter, the interior analog circuit, and a MOS transistor, and wherein the interior level shifter receives the logic signal and generates a switch signal, the interior analog circuit comprises a plurality of operational amplifiers, a gate of the MOS transistor is coupled with the switch signal, a source of the MOS transistor is coupled with a VDD source, a drain of the MOS transistor is coupled with a power supply terminal of each operational amplifier, and the switch signal controls turn-on or turn-off of the MOS transistor to turn: on or turn-off each operational amplifier.

6. The method according to claim 5, wherein the interior analog circuit of the source driver is switched off when the logic signal is OFF, and is switched on when the logic signal is ON, so that pictures displayed by liquid crystal display panel can be normally updated.

7. The method according to claim 5, wherein the external control signals comprise display image signals, an enabling signal, a clock signal, a vertical synchronizing signal and a horizontal synchronizing signal.

8. The method according to claim 5, wherein the driving control signals comprise image signals, a row starting signal, a latch signal and polarity reversing signals to be sent to the source driver, and a column starting signal, a column clock signal and output enabling signals to be sent to the gate driver.

9. The method according to claim 5, wherein the drain of the MOS transistor is directly coupled with the power supply terminal of each operational amplifier.

* * * * *